US005617962A

United States Patent [19]

Chen

[11] Patent Number: 5,617,962

[45] Date of Patent: Apr. 8, 1997

[54] FOLDING COLLAPSIBLE CLOTHES RACK

[76] Inventor: Hsien A. Chen, No. 63, Lane 2, Hsia Lin Road, Tainan City, Taiwan

[21] Appl. No.: 504,590

[22] Filed: Jul. 20, 1995

[51] Int. Cl.[6] ..... A47F 5/00

[52] U.S. Cl. ..... 211/206; 211/204; 211/207

[58] Field of Search ..... 211/206, 204, 211/189, 207, 195, 175

[56] References Cited

U.S. PATENT DOCUMENTS

| | | | |
|---|---|---|---|
| 1,687,613 | 10/1928 | Hernacki | 211/204 |
| 1,830,282 | 11/1931 | Lorch | 211/204 |
| 2,533,324 | 12/1950 | Mendle | 211/206 |
| 2,793,764 | 5/1957 | Stork | 211/204 |
| 3,144,946 | 8/1964 | Ellis | 211/206 X |
| 3,483,999 | 12/1969 | Barrett | 211/204 |
| 3,499,541 | 3/1970 | Mackie | 211/206 X |
| 3,503,525 | 3/1970 | Loebner | 211/206 |
| 3,620,377 | 11/1971 | Holtz | 211/206 |
| 3,863,769 | 2/1975 | Goddard | 211/206 X |

*Primary Examiner*—Robert W. Gibson, Jr.
*Attorney, Agent, or Firm*—Jones, Tullar & Cooper, P.C.

[57] ABSTRACT

A folding collapsible clothes rack including two parallel stands respectively equipped with rollers for movement, two uprights respectively pivoted to the stands and secured in an operative position by tightening up screws and spring plates, two bottom connecting rods pivotably connected together and respectively pivoted to the uprights and then secured in the operative position by tightening up screws and spring plates, a top tube for hanging clothes, two pistons respectively moved in the uprights at the top to hold the top tube and secured at the desired elevation relative to the respective upright by a respective lock, each piston having a top end turned about a respective pivot on a downward coupling plate at one end of the top tube and secured in the operative position by a respective tightening up screw and a respective spring plate.

5 Claims, 10 Drawing Sheets

A

C

FOLDING COLLAPSIBLE CLOTHES RACK

BACKGROUND OF THE INVENTION

The present invention relates to clothes racks, and relates more particularly to a folding collapsible clothes rack which can be conveniently folded up into a collapsed flat condition when not in use.

Various clothes racks have been disclosed for hanging clothes, and have appeared on the market. FIG. 1A shows a detachable clothes rack according to the prior art, which comprises two parallel stands (100) respectively equipped with rollers (300) for moving, a stretcher (200) connected between the stands (100), two uprights (400) respectively and vertically mounted on the stands (100), two pistons (500) adjustably fastened to the uprights (400), a top tube (600) horizontally supported on the pistons (500) at the top, and two extension rods (700) adjustably fastened to two opposite ends of the top tube (600). This structure of a clothes rack is still not functionally satisfactory. Because the stretcher is not collapsible, the detachable clothes rack still occupies much storage space when collapsed. Furthermore, the assembly process as well as the dismounting process of this structure of a detachable clothes rack are complicated. Because the parts of this structure of a detachable clothes rack are connected with one another by screws, they must be disconnected from one another so that the detachable clothes rack can be collapsed. However, when the parts of the detachable clothes rack are disconnected from one another, they tend to slip away from one another.

SUMMARY OF THE INVENTION

The present invention provides a folding collapsible clothes rack which eliminates the aforesaid drawbacks. According to the preferred embodiment of the present invention, the folding collapsible clothes rack comprises two parallel stands respectively equipped with rollers for moving, two uprights respectively pivoted to the stands and secured in the operative position by tightening up screws and spring plates, two bottom connecting rods pivotably connected together and respectively pivoted to the uprights and then secured in the operative position by tightening up screws and spring plates, a top tube for hanging clothes, two pistons respectively moved in the uprights at the top to hold the top tube and secured at the desired elevation by a respective lock, each piston having a top end turned about a respective pivot on a downward coupling plate at one end of the top tube and secured in the operative position by a respective tightening up screw and a respective spring plate. Because most parts of the folding collapsible clothes rack are pivotably connected together, they do not slip from one another when they are collapsed.

DETAILED DESCRIPTION OF THE PREFERRED EMBODIMENT

Figure 1A:
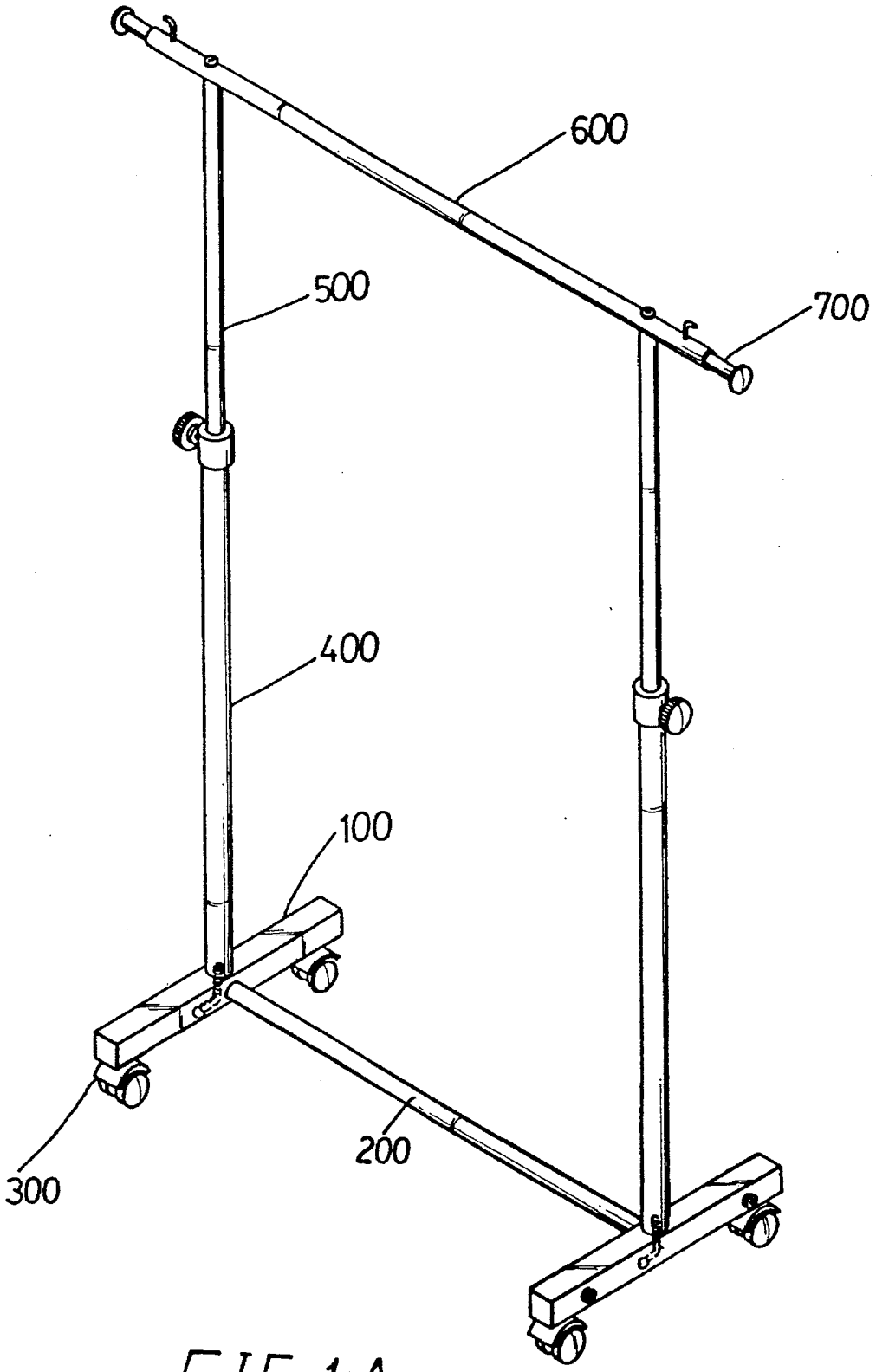
FIG.1A (Prior Art)
FIG. 1A is an elevational view of a folding collapsible clothes rack according to the prior art.
Figure 1B:
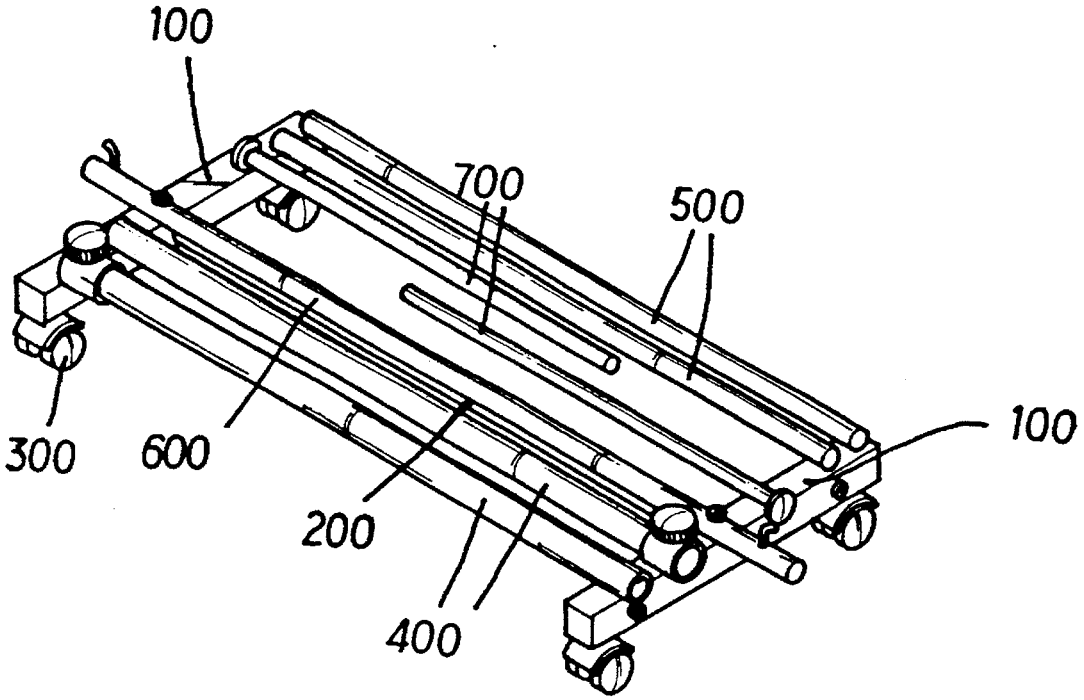
FIG. 1B (Prior Art)
FIG. 1B shows the folding collapsible clothes rack of FIG. 1A collapsed.
Figure 2:
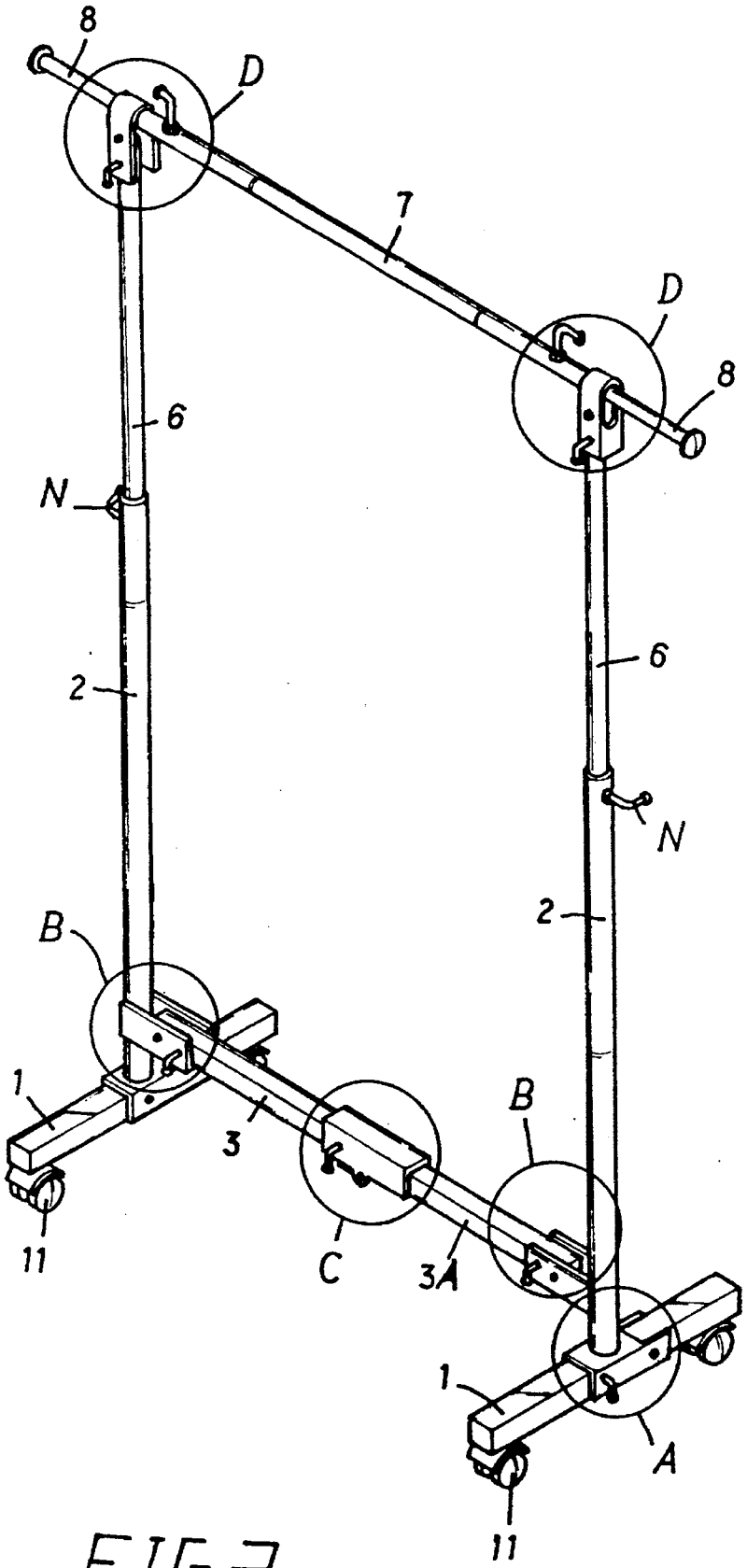
FIG. 2 is an elevational view of a folding collapsible clothes rack according to the present invention.

Referring to FIG. 2, a folding collapsible clothes rack in accordance with the present invention is generally comprised of two stands 1, two uprights 2, a first bottom connecting rod 3, a second bottom connecting rod 3A, two pistons 6, a top tube 7, and two extension rods 8.

Figure 3:
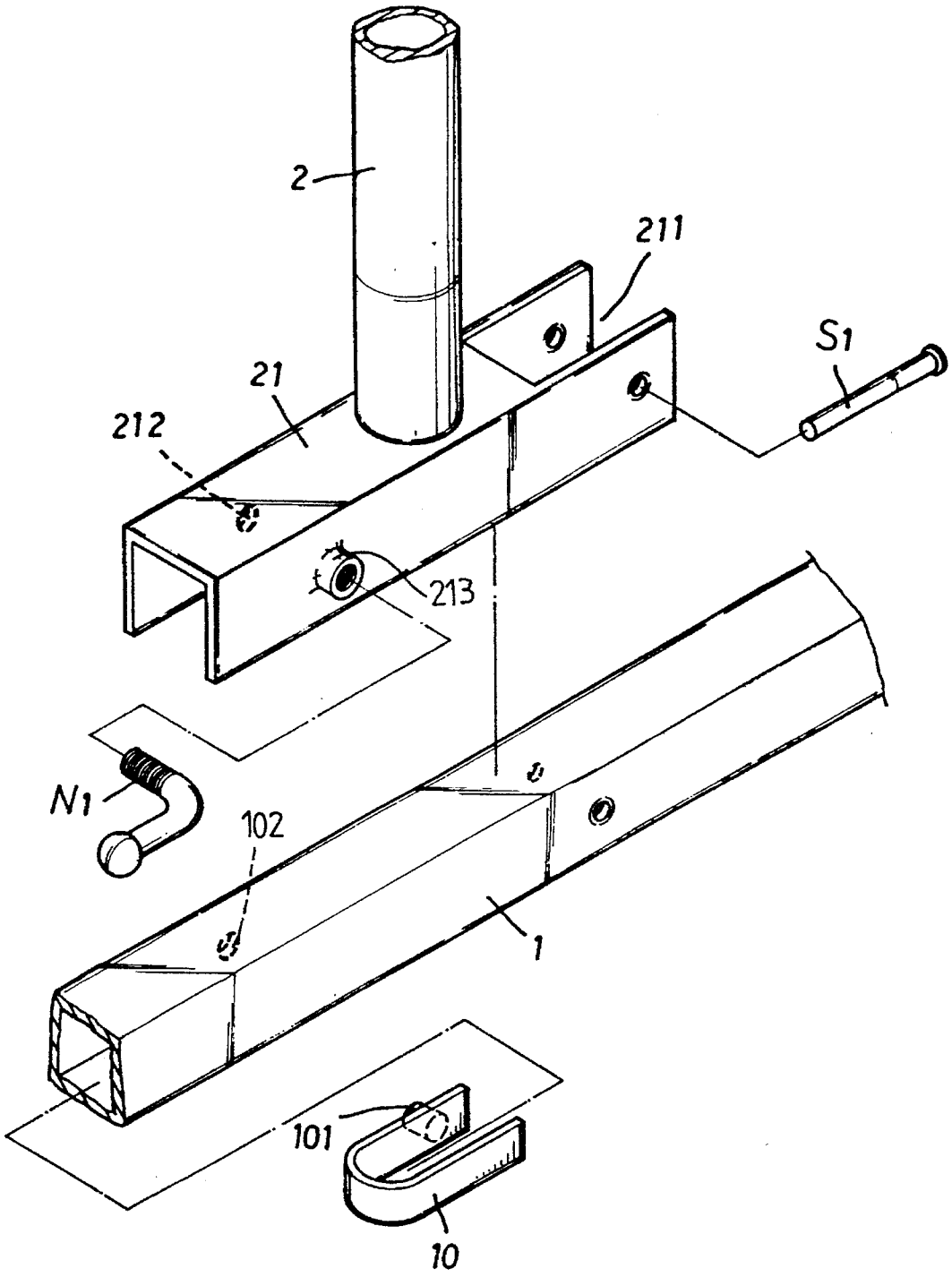
FIG. 3 is an exploded view to an enlarged scale taken of part A of FIG. 2.
Figure 4:
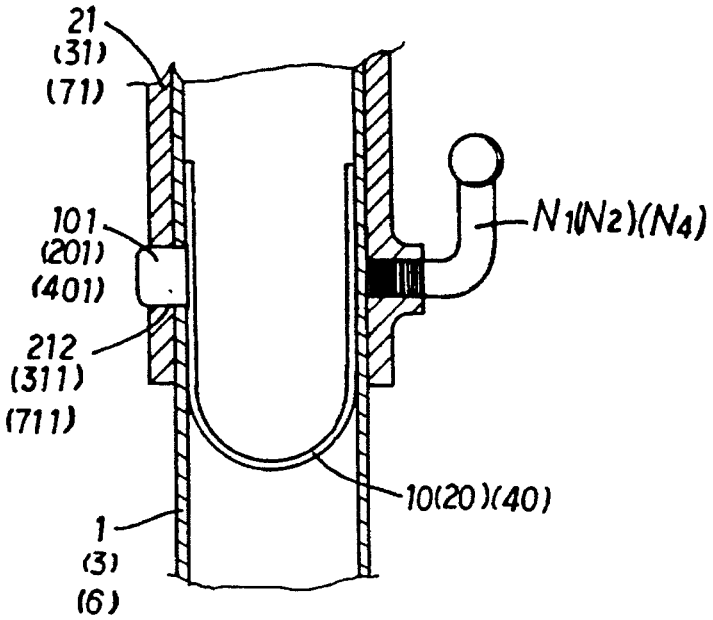
FIG. 4 is a sectional view showing two parts connected together,by a U-shaped spring plate and a tightening up screw according to the present invention.

Referring to FIGS. 3 and 4 and FIG. 2 again, the stands 1 are arranged in parallel, each having two rollers 11 at two opposite ends and a U-shaped spring plate 10 on the inside, which shaped spring plate 19 having a rod 101 at one side extended out of a through hole 102 on the respective stand 1.

Figure 5:
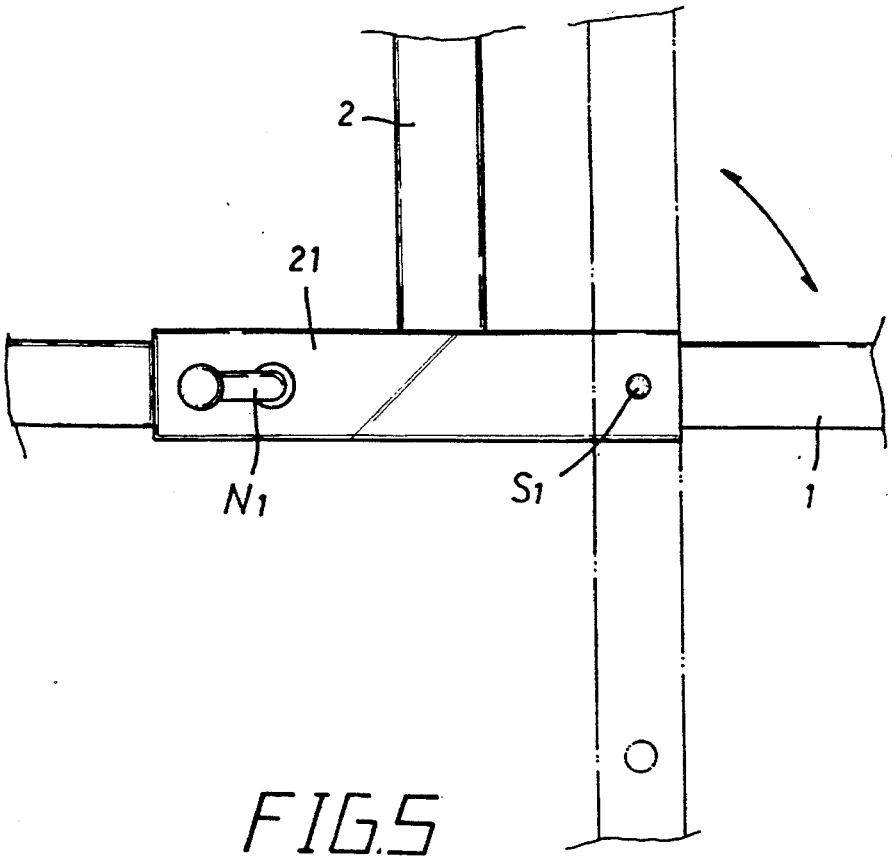
FIG. 5 is an assembly view of FIG. 3, showing the upright turned relative to the stand between the operative position and the collapsed position.
Figure 7:
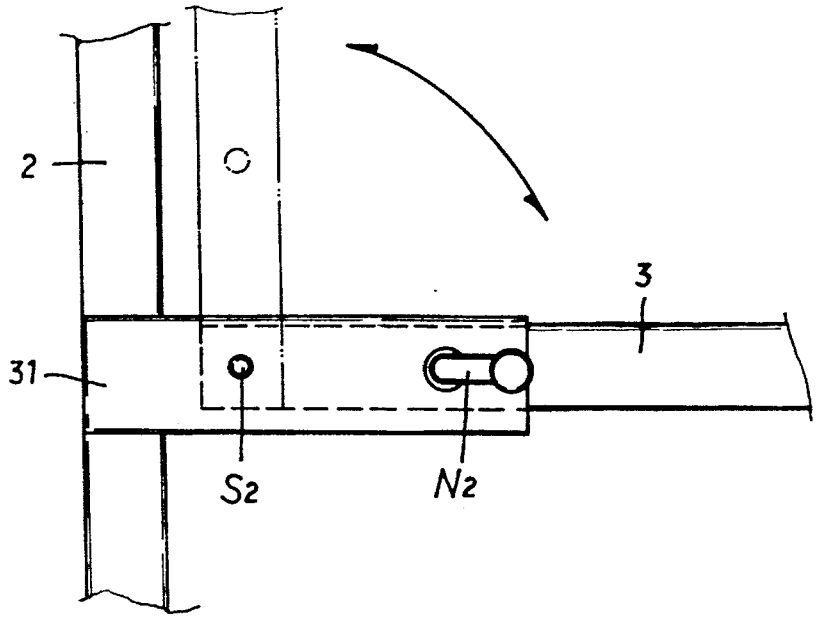
FIG. 7 is an assembly view of FIG. 6, showing the bottom connecting rod turned about the pivot relative to the upright between the operative position and the collapsed position.

Referring to FIG. 5 and FIGS. 2, 3, and 4 again, the upright 2 has a channel mount 21 at the bottom fastened to one stand 1. The channel mount 21 comprises two parallel lugs 211 at one end pivoted to one stand 1 by a pivot pin S1, a screw hole 213 and a locating hole 212 bilaterally disposed at an opposite end. When the lugs 211 are pivoted to the stand 1, the channel mount 21 can be turned between the operative position (in which the upright 2 is disposed perpendicular to the stand 1) and the collapsed position (in which the upright 2 is disposed parallel to the stand 1)). When the channel mount 21 is turned to the operative position to hold the respective upright 2 in the vertical position, the rod 101 of the respective U-shaped spring plate 10 is inserted into the locating hole 212 to hold the respective upright 2 in position, then a tightening up screw N1 is threaded into the screw hole 213 to fix the channel mount 21 in position.

Figure 6:
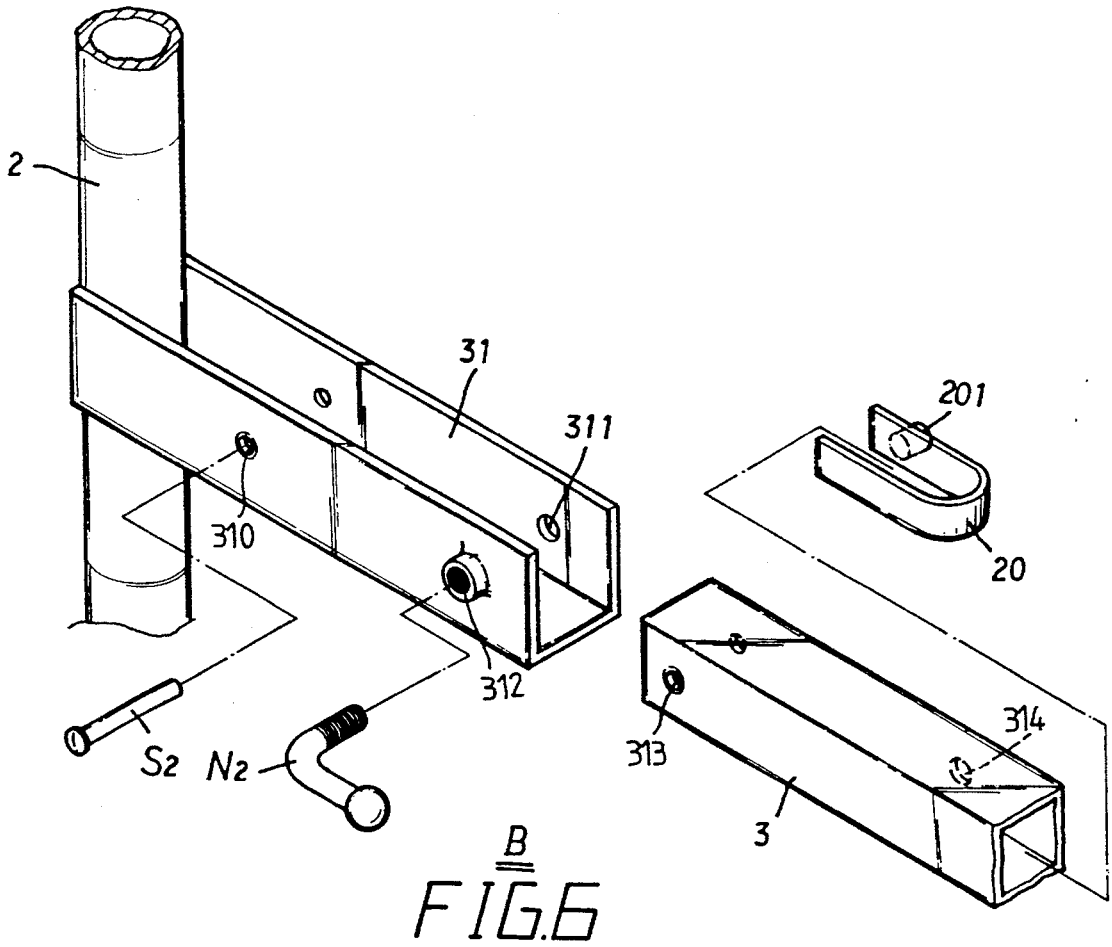
FIG. 6 is an exploded view to an enlarged scale taken of part B of FIG. 2.
Figure 8:
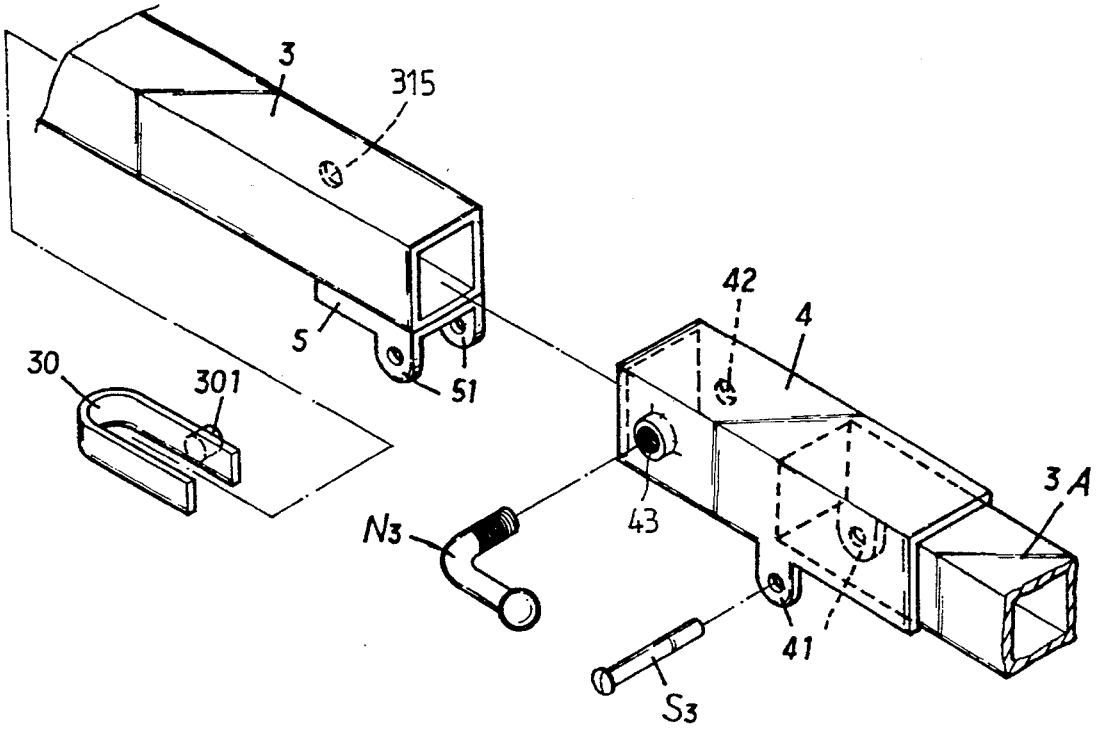
FIG. 8 is an exploded view to an enlarge scale taken of part C of FIG. 2.
Figure 9:
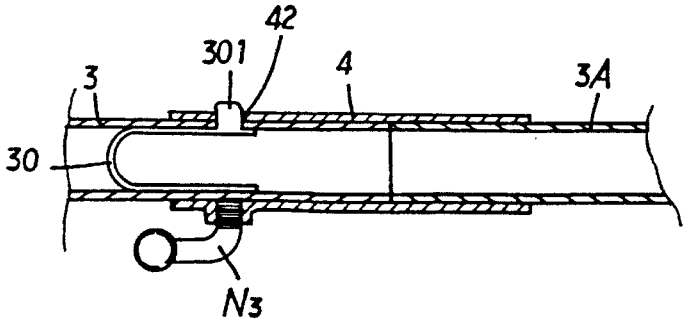
FIG. 9 is a sectional assembly view of FIG. 8.
Figure 10:
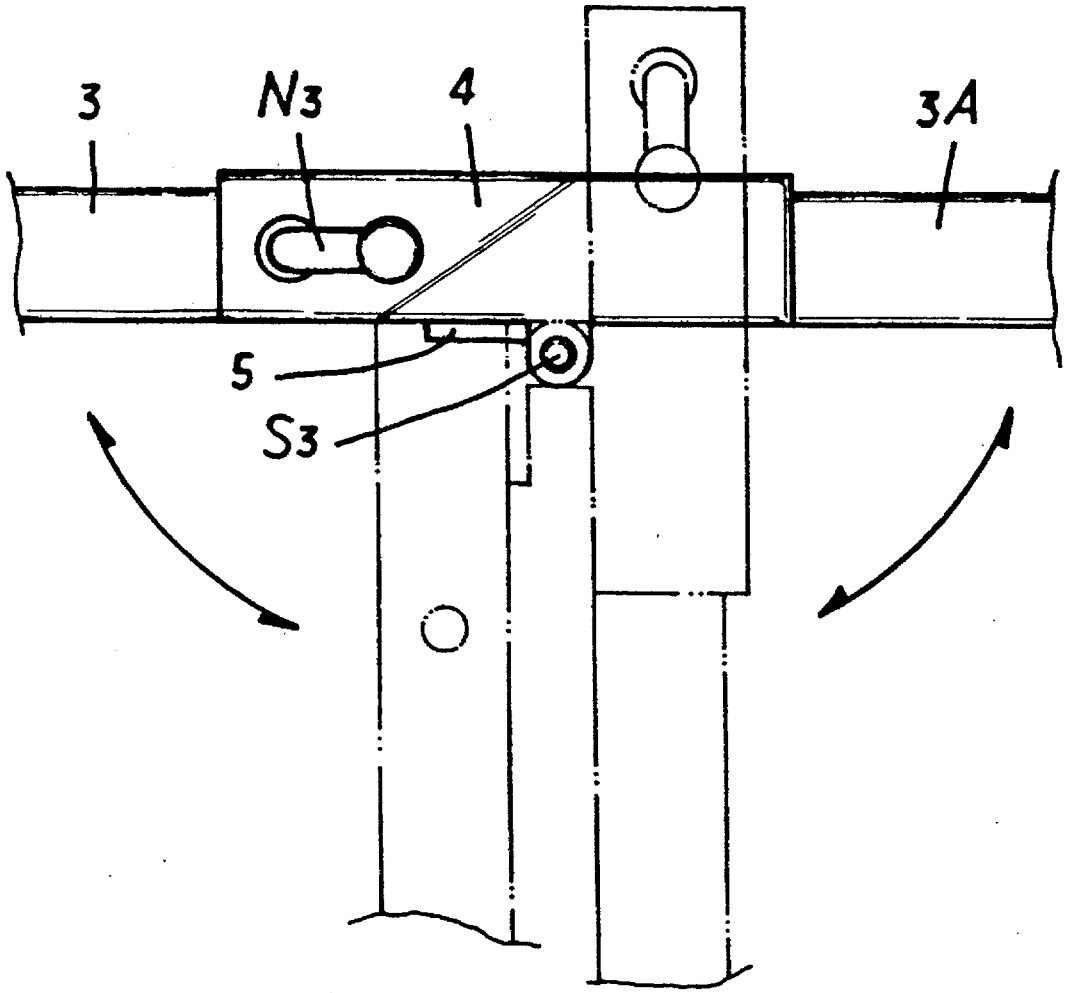
FIG. 10 is an assembly view of FIG. 8, showing the first bottom connecting rod and the second bottom connecting rod turned relative to each other between the operative position and the collapsed position.

Referring to FIGS. 6 to 10 and FIGS. 2, 4, and 6 again, the bottom connecting rods 3 and 3A are longitudinally connected together between the stands 1. Each bottom connecting rod 3 or 3A has a pivot hole 313 at one end pivotably connected between two pivot holes 310 on an upper channel mount 31, which is fixedly secured to one upright 2 above the respective bottom channel mount 21, by a pivot pin S2, and a through hole 314 adjacent to the pivot hole 313. A U-shaped spring plate 20 is mounted inside the bottom connecting rod 3 or 3A, having a rod 201 at one side extended out of the through hole 314 and inserted into a locating hole 311 on the upper channel mount 31 (see FIG. 6). A tightening up screw N2 is threaded into a screw hole 312 on the upper channel mount 3 and stopped against the outside wall of the first bottom connecting rod 3 to fix the connection between the first bottom connecting rod 3 and the upper channel mount 31 (see FIG. 4). The opposite end of the first bottom connecting rod 3 is fixedly mounted with a coupling plate 5 at the bottom, which coupling plate 5 has two downward lugs 51. A U-shaped spring plate 30 is mounted inside the first bottom connecting rod 3, having a rod 301 at one side extended out of a through hole 315 on the first bottom connecting rod 3. The opposite end of the second bottom connecting rod 3A is fixedly mounted with a channel mount 4, which receives the first bottom connecting rod 3. The channel mount 4 has two downward lugs 41 bilaterally disposed in the middle and pivotably connected to the downward lugs 51 of the first bottom connecting rod 3 by a pivot N3 (see FIG. 10), a locating hole 42 and a screw hole 43 bilaterally disposed near the end. When the second bottom connecting rod 3A is longitudinally aligned with the first bottom connecting rod 3, the rod 301 is inserted into the locating hole 42 to hold the second bottom connecting rod 3A in place. Then, a tightening up screw N3 is threaded into the screw hole 43 and stopped against the outside wall of the first bottom connecting rod 3 to fix the connection between the first bottom connecting rod 3 and the second bottom connecting rod 3A (see FIG. 9). When the tightening up screw N3 is disconnected from the screw hole 43, the rod 301 of the U-shaped spring plate 30 can be forced out of the locating hole 42 of the channel mount 4 for permitting the first bottom connecting rod 3 to be turned about the pivot pin S3 relative to the second bottom connecting rod 3A, and therefore the first bottom connecting rod 3 and the second bottom connecting rod 3A can be folded up (see FIG. 10).

Figure 11:
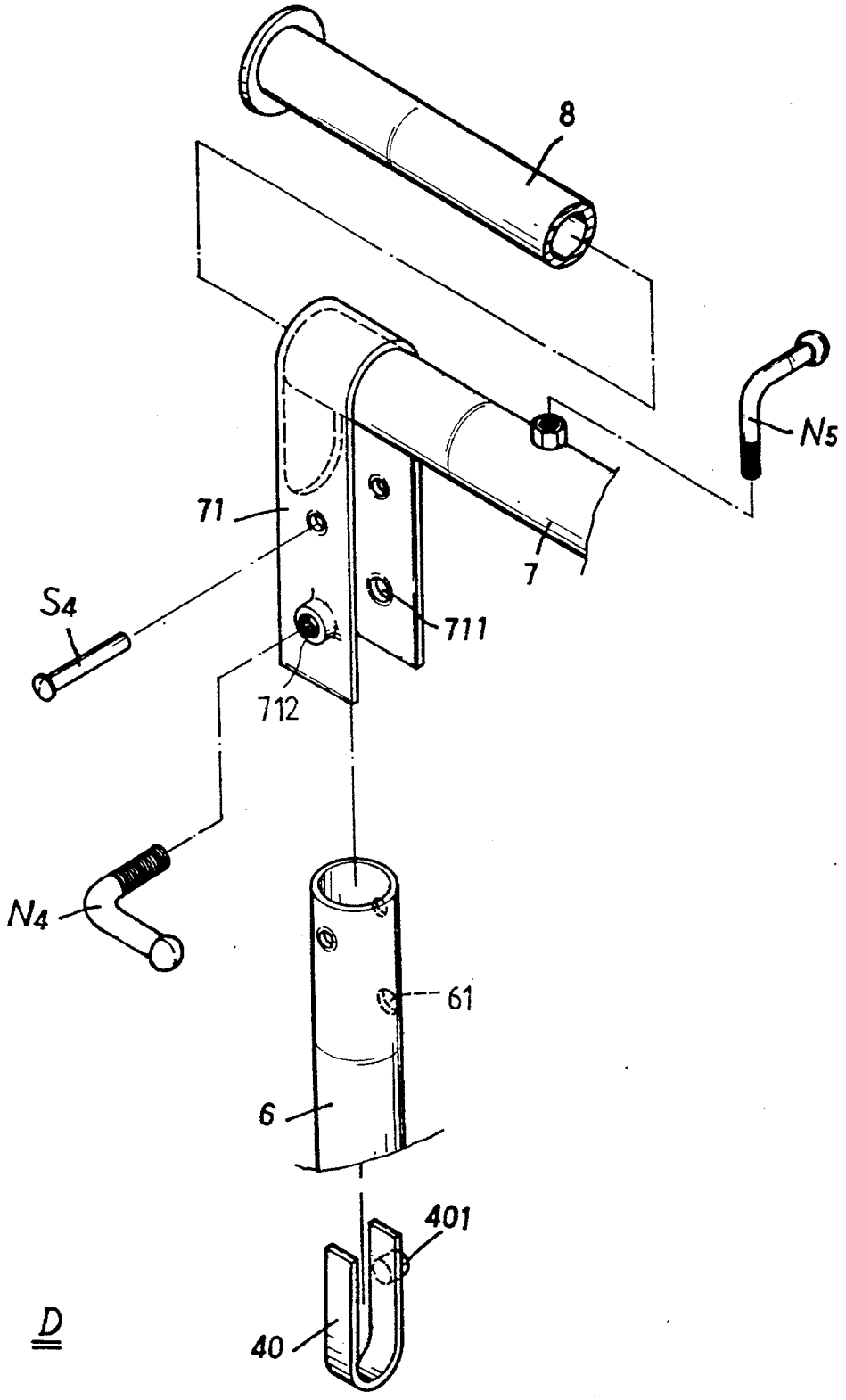
FIG. 11 is an exploded view to an enlarged scale taken of part D of FIG. 2.
Figure 12:
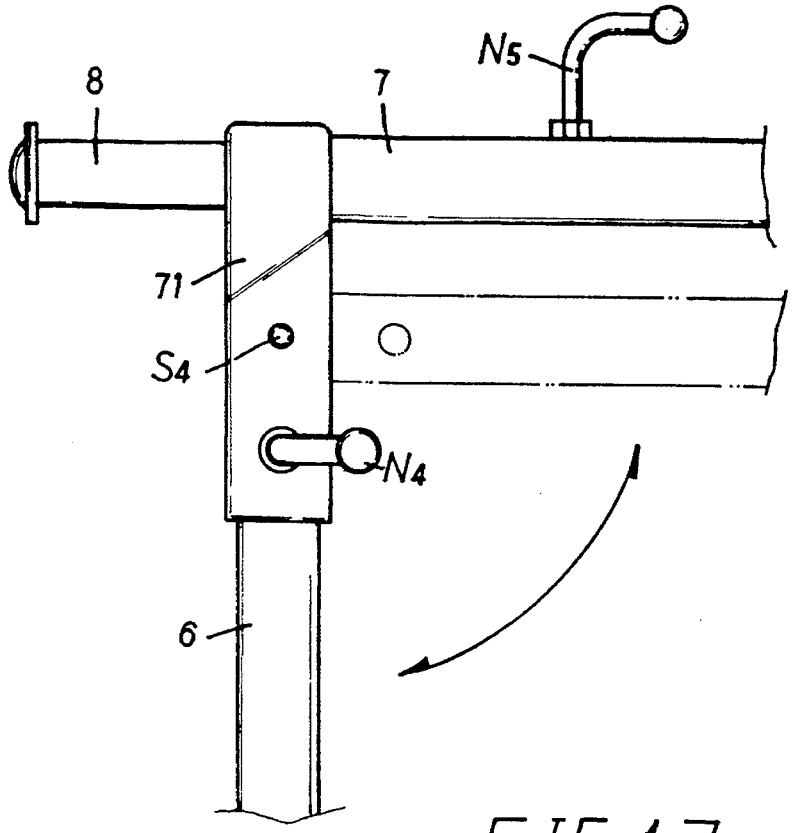
FIG. 12 is an assembly view of FIG. 11, showing the piston turned about the pivot between the operative position and the collapsed position.

Referring to FIGS. 11 and 12 and FIGS. 2 and 4 again, the piston 6 has a bottom end slidably inserted into one upright 2 and then fixed at the desired elevation by a lock N, and a top end pivotably connected to a downward coupling plate 71 at one end of the top tube 7 by a pivot pin S4. A U-shaped spring plate 40 is mounted inside the top end of the piston 6, having a rod 401 at one side extended out of a through hole 61 on the piston 6 and inserted into a locating hole 711 on the downward coupling plate 71. A tightening up screw N4 is threaded into a screw hole 712 on the downward coupling plate 71 and stopped against the outside wall of the piston 6 to fix the connection between the piston 6 and the downward coupling plate 71. When the tightening up screw N4 is disconnected from the screw hole 712 and the rod 401 is forced out of the locating hole 711, the piston 6 can be turned about the pivot pin S4 and set in parallel to the top tube 7 (see FIG. 12).

Referring to FIG. 11 again, the extension rod 8 is slidably inserted into one end of the top tube 7 and then fixed at the desired length by a tightening up screw N5.

Figure 13:
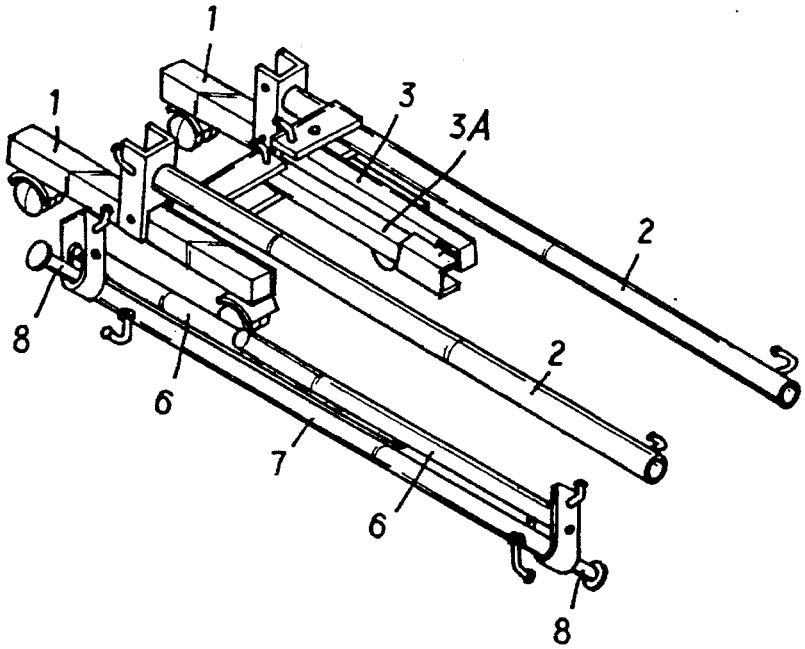
FIG. 13 shows the folding collapsible clothes rack of the present invention collapsed.

When the folding collapsible clothes rack is set in the operating position shown in FIG. 2, all the parts are fixed in position by the respective tightening up screws N1, N2, N3, N4, N5, and locks N. When not in use, the uprights 6 and the top tube 7 and the extension rods 8 are disconnected from the uprights 2, then the tightening up screws N4 are respectively disconnected from the downward couplings plates 71 at the two opposite ends of the top tube 7 and the rods 401 of the U-shaped spring plates 40 of the uprights 6 are respectively forced out of the respective locating holes 111 of the downward coupling plates 11, and then the pistons 6 are respectively turned to the collapsed position in parallel to the top tube 7 (see FIG. 12). Then, the tightening up screws N3, N2 are respectively disconnected from the bottom connecting rods 3 and 3A, and the rods 301 and 201 are respectively forced out of the respective locating holes 42 and 311, and then the bottom connecting rods 3 and 3A are respectively turned to the collapsed position parallel to the uprights 2 (see FIGS. 7 and 10), and then the uprights 2 are put together. Then, the tightening up screws N1 are respectively disconnected from the screw holes 213 of the bottom channel mounts 21 of the uprights 2 and the rods 101 are respectively forced out of the respective locating holes 212, and then the stands 1 are respectively turned upward to the collapsed position and closely attached to uprights 2 (see FIG. 5). FIG. 13 shows the folding collapsible clothes stand collapsed.

It is to be understood that the drawings are designed for purposes of illustration only, and are not intended as a definition of the limits and scope of the invention disclosed.

I claim:

1. A folding, collapsible clothes rack, comprising: two parallel stands respectively equipped with rollers for movement; two bottom connecting rods longitudinally connected between said stands; two uprights respectively and vertically mounted on said stands; two pistons slidably inserted into a respective one of said uprights and locked at a desired elevation relative to its respective upright by a respective lock; a top tube horizontally supported on said pistons; and two extension rods respectively and slidably inserted into two opposite ends of said top tube and fixed in place by a respective lock, wherein:

each upright comprises a transverse bottom channel pivotably connected to a respective stand by a first pivot pin and secured to said respective stand in the operative position by a respective first tightening up screw and a respective first U-shaped spring plate, and an upper channel mount perpendicularly spaced above said transverse bottom channel mount, said transverse bottom channel mount having one end turned about said first pivot pin and an opposite end made with a screw hole and a locating hole at two opposite sides, said upper channel mount having one end fixedly and perpendicularly connected to its upright and an opposite end made with a screw hole and a locating hole at two opposite sides, said first tightening up screw being threaded into the screw hole on the transverse bottom channel mount of its upright and stopped against the periphery of the respective stand, said first U-shaped spring being mounted inside one of said stands and having a rod at one end extended out of a hole on said respective stand and inserted into the locating hole on the transverse bottom channel mount of its upright;

each of said bottom connecting rods has a first end pivotably connected to the upper channel mount of its upright by a respective second pivot pin and secured in the operative position by a respective second tightening up screw and a respective second U-shaped spring, and a second end pivotably connected to each other by a third pivot pin and secured in the operative position by a third tightening up screw and a third U-shaped spring plate, said second tightening up screw being threaded into the screw hole on said respective upper channel mount and stopped against the periphery of one bottom connecting rod, said second U-shaped spring plate being mounted inside one bottom connecting rod at one end and having a rod at one end extended out of a hole on said respective bottom connecting rod and inserted into the locating hole on said respective bottom channel mount, said second bottom connecting rod having a channel mount at the second end, the channel mount of said second bottom connecting rod having a screw hole and a locating hole bilaterally disposed at one end and a pair of downward lugs bilaterally disposed in the middle, said second and third pivot pins being connected between the downward lugs of the channel mount of said second bottom connecting rod, said first bottom connecting rod having a coupling plate at the second end, said coupling plate having two downward lugs turned about said third pivot pin, said third tightening up screw being threaded into the screw hole on the channel mount of said second bottom connecting rod and stopped against the periphery of said first bottom connecting rod, said third U-shaped spring plate being mounted inside the second end of said first bottom connecting rod and having a rod extended out of a hole on the second end of said first bottom connecting rod and inserted into the locating hole on the channel mount of said second bottom connecting rod;

said top tube has two downward coupling plates at two opposite ends respectively and pivotably connected to said pistons by a respective fourth pivot pin, each downward coupling plate having a screw hole and a locating hole at two opposite sides;

each piston is turned about the fourth pivot pin on one downward coupling plate of said top tube and secured in the operative position by a respective fourth tightening up screw and a fourth U-shaped spring plate, said fourth tightening up screw being threaded into the screw hole on one downward coupling plate of said top tube and stopped against the periphery of its respective piston, said fourth U-shaped spring plate being mounted inside the top end of one piston and having a rod extended out of a hole on the top end of its respective piston and inserted into the locating hole on its respective downward coupling plate.

2. A folding, collapsible clothes rack, comprising: two parallel stands respectively equipped with rollers for movement; two bottom connecting rods longitudinally connected between said stands; two uprights respectively and vertically inserted into a respective one of said stands; two pistons slidably inserted into a respective one of said uprights and locked at a desired elevation relative to its respective upright; a top tube horizontally supported on said pistons; and two extension rods respectively and slidable inserted into two opposite ends of said top tube and fixed in place by a respective lock, wherein:

each upright comprises a transverse bottom channel pivotably connected to a respective stand by a first pivot pin and secured to said respective stand in the operative position by a respective first tightening up screw and a respective first U-shaped spring plate, and an upper channel mount perpendicularly spaced above said transverse bottom channel mount, said transverse bottom channel mount having one end turned about said first pivot pin and an opposite end made with a screw hold an a locating hole at two opposite sides, said upper channel mount having one end fixedly and perpendicularly connected to its upright and an opposite end made with a screw hold and a locating hold at two opposite sides, said first tightening up screw being threaded into the screw hold on the transverse bottom channel mount of its upright and stopped against the periphery of the respective stand, said first U-shaped spring being mounted inside one of said stands and having a rod at one end extended out of a hole on said respective stand and inserted into the locating hole on the transverse bottom channel mount of its upright.

3. The folding, collapsible clothes rack as defined in claim 2, wherein:

each of said bottom connecting rods has a first end pivotably connected to the upper channel mount of its upright by a respective second pivot pin and secured in the operative position by a respective second tightening up screw and a respective second U-shaped spring, and a second end pivotably connected to each other by a third pivot pin and secured in the operative position by a second tightening up screw and a third U-shaped spring plate, said second tightening up screw being threaded into the screw hold on said respective upper channel mount and stopped against the periphery of one bottom connecting rod, said second U-shaped spring plate being mounted inside one bottom connecting rod at one end and having a rod at one end extended out a hole on said respective bottom connecting rod and inserted into the locating hole on said respective bottom channel mount, said second bottom connecting rod having a channel mount at the second end, the channel mount of said second bottom connecting rod having a screw of downward lugs bilaterally disposed in the middle, said second and third pivot pins being connected between the downward lugs of the channel mount of said second bottom connecting rod, said first bottom connecting rod having a coupling plate at the second end, said coupling plate having two downward lugs turned about said third pivot pin, said third tightening up screw being threaded into the screw hole on the channel mount of said second bottom connecting rod and stopped against the periphery of said first bottom connecting rod, said third U-shaped spring plate being mounted inside the second end of said first bottom connecting rod and having a rod extended out of a hole on the second end of said first bottom connecting rod and inserted into the locating hole on the channel mount of said second bottom connecting rod.

4. The folding, collapsible clothes rack as defined in claim 3, wherein:

said top tube has two downward coupling plates at two opposite ends respectively and pivotably connected to said pistons by a respective and pivotably connected to said pistons by a respective fourth pivot pin, each downward coupling plate having a screw hole and a locating hole at two opposite sides.

5. A folding, collapsible clothes rack, comprising: two parallel stands respectively equipped with rollers for movement; two bottom connecting rods longitudinally connected between said stands; two uprights respectively and vertically mounted on said stands by a pivot pin and secured to said respective stand in the operative positions by a respective tightening up screw and a respective U-shaped spring plate mounted inside said respective stands; two pistons slidably inserted into a respective one of said uprights and locked at a desired elevation relative to its respective upright; a top tube horizontally supported on said pistons; and two extension rods respectively and slidably inserted into two opposite ends of said top tube and fixed in place by a respective lock.

* * * * *